US006030164A

United States Patent [19]

Chin-Chang et al.

[11] Patent Number: 6,030,164

[45] Date of Patent: Feb. 29, 2000

[54] DEVICE FOR MELTING A LASHING TAPE OF BINDING MACHINE

[75] Inventors: Liu Chin-Chang; Su Chi-Chan, both of Taichung, Taiwan

[73] Assignees: Tekpak Corporation of TaiChung City, TaiChung; Transpak Equipment Corporation, Taipei, both of Taiwan

[21] Appl. No.: 09/320,601

[22] Filed: May 26, 1999

[51] Int. Cl.[7] ..... B42C 13/00

[52] U.S. Cl. ..... 412/14; 36/902

[58] Field of Search ..... 412/8, 9, 13, 14, 412/33, 36, 37, 41, 900, 901, 902; 156/583.1, 583.2, 583.4, 583.7, 583.9

[56] References Cited

U.S. PATENT DOCUMENTS

| | | | |
|---|---|---|---|
| 3,939,513 | 2/1976 | Crathern, IIi | 412/902 X |
| 4,014,732 | 3/1977 | Beckert et al. | 412/902 X |
| 5,219,453 | 6/1993 | Fuenkawa et al. | 412/902 X |
| 5,501,765 | 3/1996 | Hashimoto | 412/902 X |

*Primary Examiner*—Willmon Fridie, Jr.
*Attorney, Agent, or Firm*—Harrison & Egbert

[57] ABSTRACT

A device for heating and melting both ends of a lashing tape of a binding machine at the conclusion of a binding process is formed of a housing and an electrical heater which is disposed in the housing and provided with a plurality of current conducting and heat generating lines and a plurality of temperature sensing lines connected with a control switch of the binding machine for regulating the operation of the binding machine and the power supply to the current conducting and heat generating lines of the device.

1 Claim, 4 Drawing Sheets

DEVICE FOR MELTING A LASHING TAPE OF BINDING MACHINE

FIELD OF THE INVENTION

The present invention relates generally to a lashing tape of a binding machine, and more particularly to a device of the binding machine for melting both ends of a lashing tape at the time when the binding process is completed.

BACKGROUND OF THE INVENTION

As shown in FIGS. 1 and 2, a prior art device for melting a lashing tape of the binding machine is composed of a U-shaped heat conducting piece 11, an electrically conductive loop 12 disposed in the heat conducting piece 11, and a plurality of locating pieces 14 fastened with the heat conducting piece 11 by a plurality of bolts 13. When the binding machine is started, the power source is made available to the heat conducting piece 11 via the electrically conductive loop 12. The heat conducting piece 11 is heated to reach a predetermined temperature capable of melting both ends of a lashing tape at the time when a binding work is done.

Such a prior art heating device as described above is defective in design in that the device is devoid of a means for indicating the precise timing at which the predetermined temperature is attained, and that the device is incapable of interrupting the power source at the time when the predetermined temperature has attained.

SUMMARY OF THE INVENTION

It is therefore the primary objective of the present invention to provide a binding machine with a device capable of melting both ends of a lashing tape of the binding machine in such a fashion that the binding process can not be started unless a predetermined temperature of the device has attained.

It is another objective of the present invention to provide a binding machine with an energy-efficient device for melting both ends of a lashing tape of the binding machine. The device is capable of interrupting the power source as soon as the predetermined temperature of the device has attained.

The objectives, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
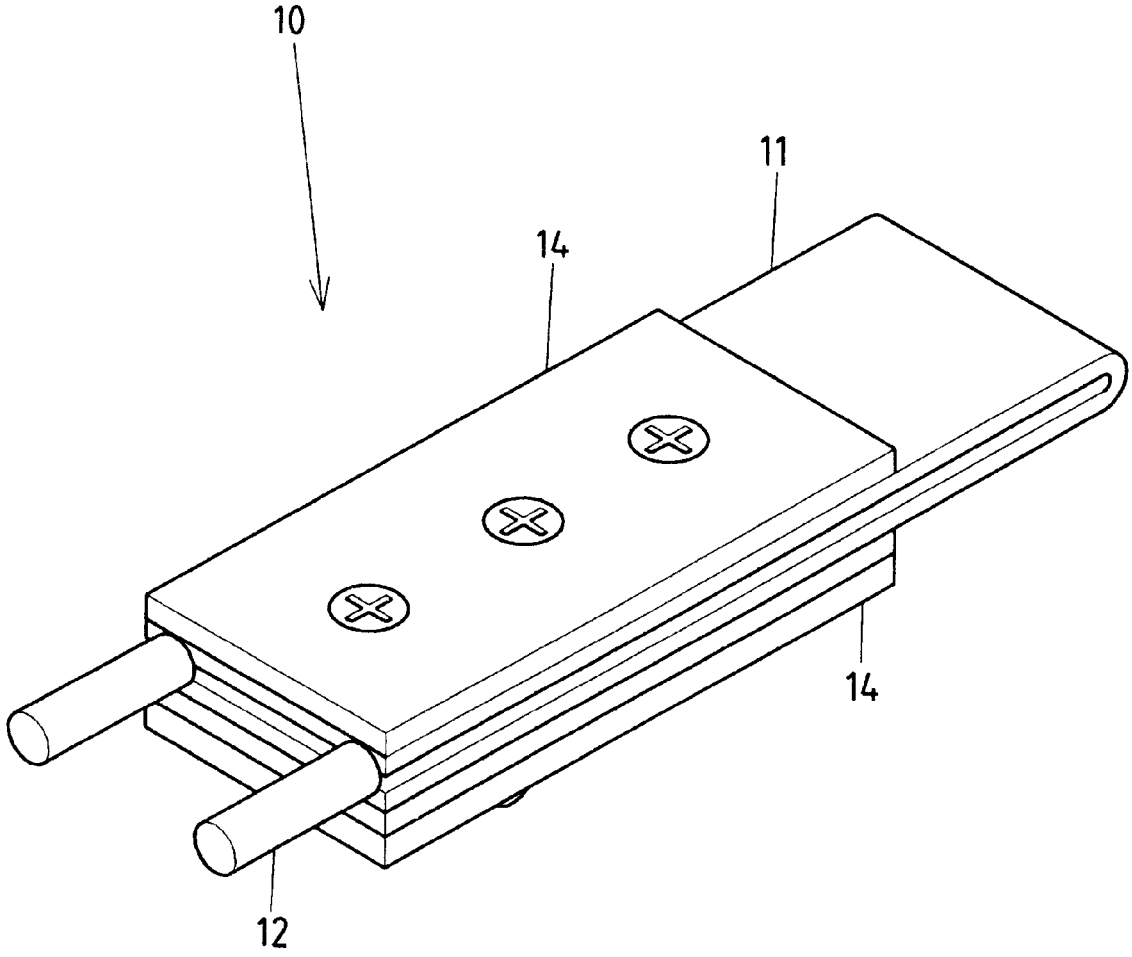
FIG.1 (PRIOR ART)
FIG. 1 shows a perspective view of a heating element of a prior art device for melting the lashing tape of a binding machine.
Figure 2:
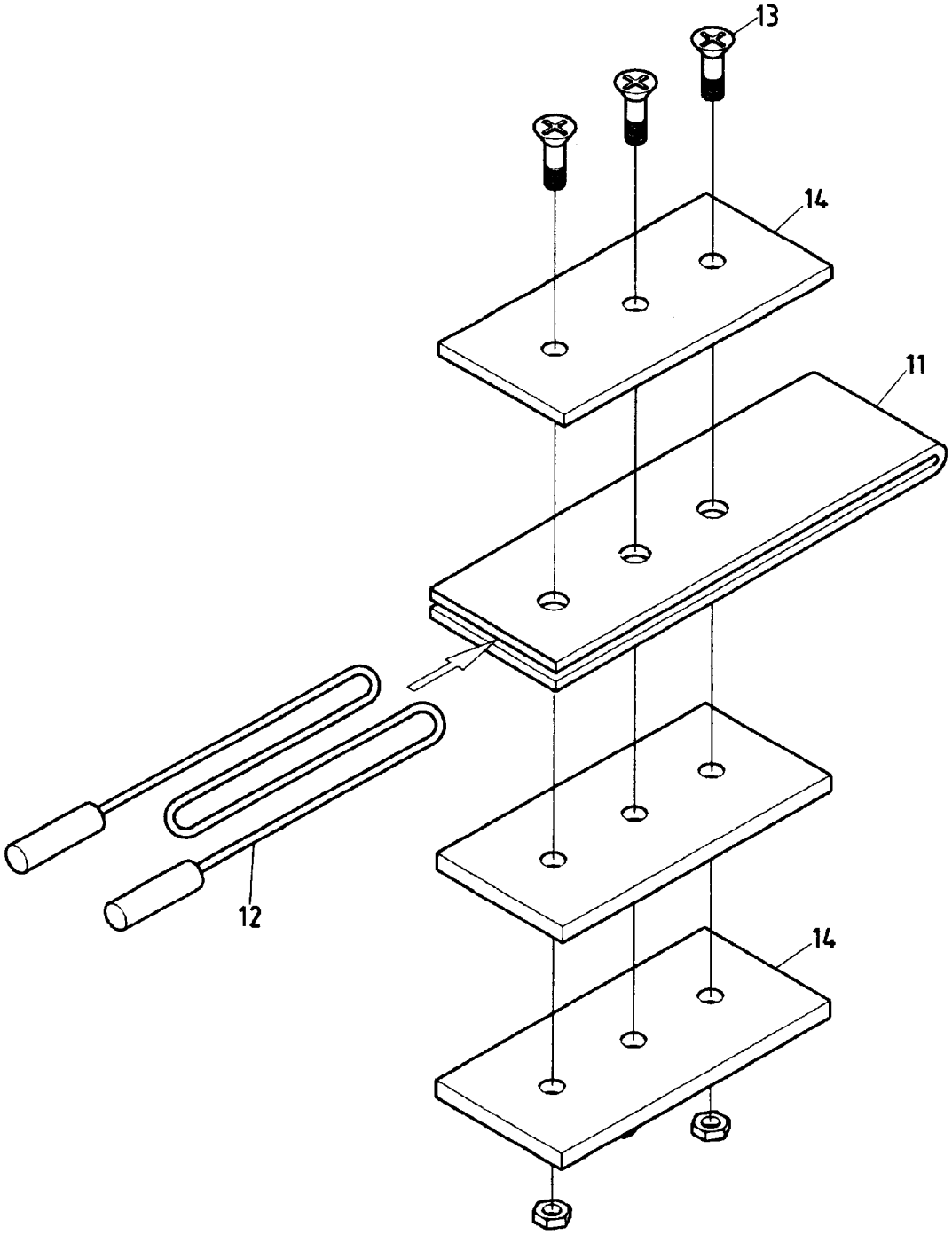
FIG. 2 (PRIOR ART)
FIG. 2 shows an exploded view of the heating element of the prior art device as shown in FIG. 1.
Figure 3:
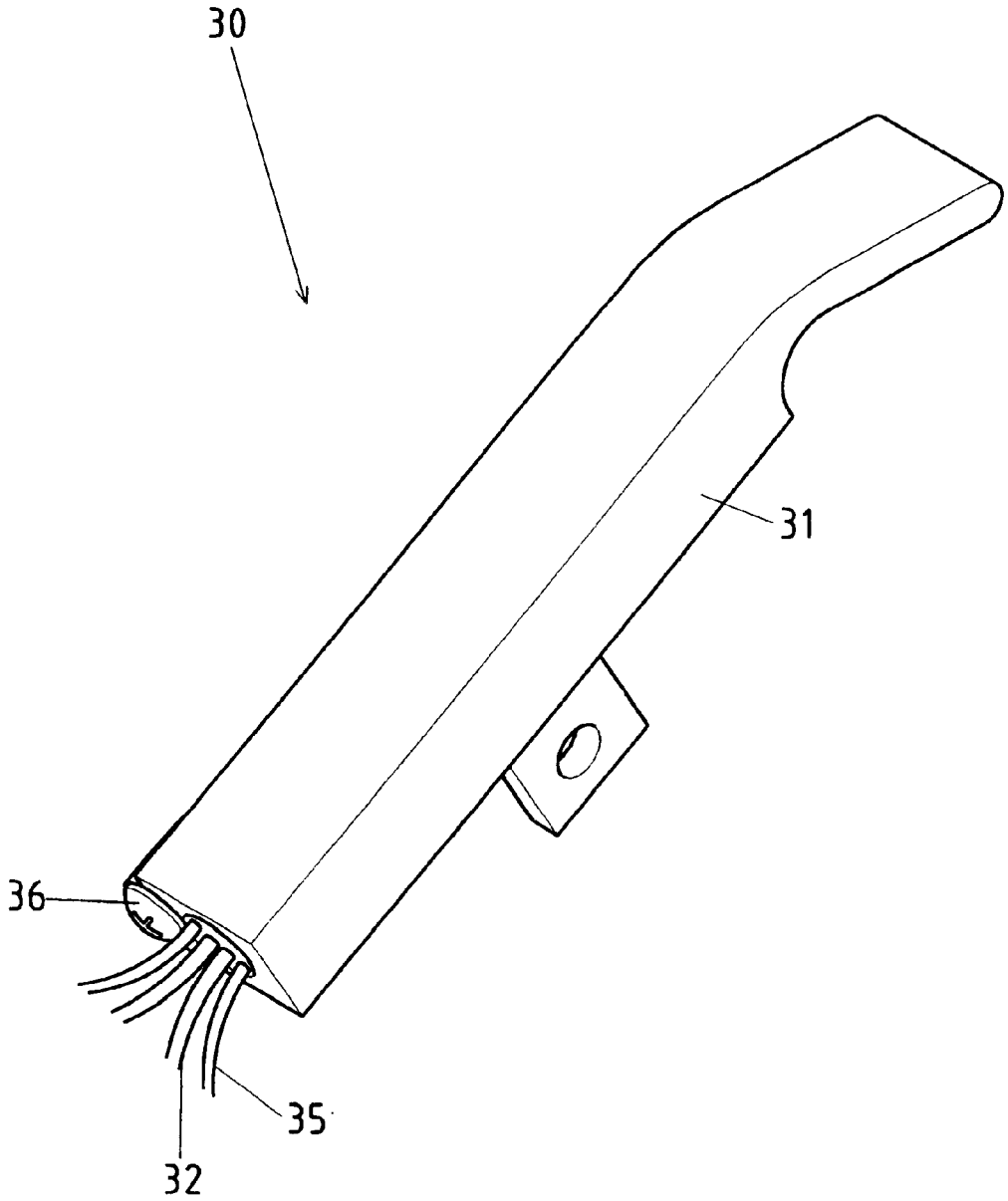
FIG. 3 shows a perspective view of the preferred embodiment of the present invention.
Figure 4:
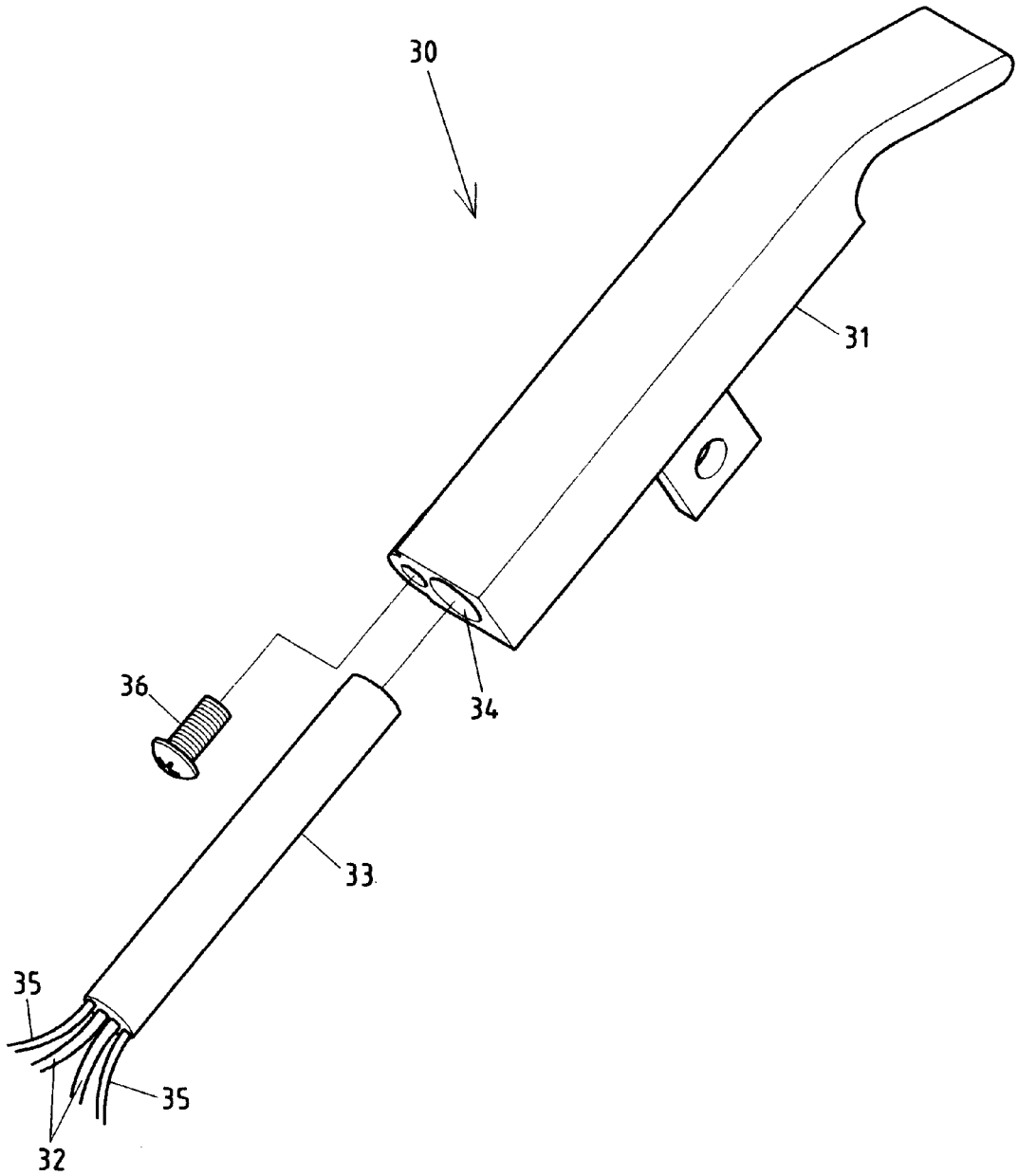
FIG. 4 shows an exploded view of the preferred embodiment of the present invention.

As shown in FIGS. 3 and 4, a device 30 embodied in the present invention is disposed in a binding machine for melting both ends of a lashing tape of the binding machine at the conclusion of a binding process, and is formed of a housing 31 and an electrical heater 33 which is provided with a plurality of current conducting and heat generating lines 32 and a plurality of temperature sensing lines 35. The housing 31 is provided with a longitudinal hole 34 for receiving the heater 33 such that the temperature sensing lines 35 of the heater 33 are connected with a control switch of the binding machine. The housing 31 is further provided with a threaded hole for fastening the housing 31 with the binding machine by a fastening bolt 36, which is engaged with the threaded hole.

When the temperature of the device 30 has not reached a predetermined level, the binding machine can not be started. As soon as the temperature of the device 30 has attained the predetermined level, the temperature sensing lines 35 send a signal to the binding machine to interrupt the supply of power to the current conducting lines 32 so as to save energy. When the temperature of the device drops under the predetermined level, the temperature sensing lines 35 send a signal to the binding machine to resume the power supply to the lines 32.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

We claim:

1. A device for heating and melting both ends of a lashing tape of a binding machine at a conclusion of a binding process, the device being disposed in the binding machine and formed of a housing provided with a receiving hole, and an electrical heater disposed in said receiving hole of said housing and provided with a plurality of current conducting and heat generating lines and a plurality of temperature sensing lines, with said temperature sensing lines being connected with a control switch of the binding machine, whereby said temperature sensing lines send a signal to the control switch of the binding machine to prevent the binding machine from operating at such time when the temperature of said device has not reached a predetermined level, whereby said temperature sensing lines send a signal to the control switch of the binding machine to interrupt the power supply to said current conducting and heat generating lines of said device as soon as the temperature of said device has reached the predetermined level, and whereby said temperature sensing lines send a signal to the control switch of the binding machine to resume the power supply to said current conducting and heat generating lines of said device as soon as the temperature of said device has dropped under the predetermined level.

* * * * *